US008488993B2

(12) United States Patent
Hashimoto et al.

(10) Patent No.: US 8,488,993 B2
(45) Date of Patent: Jul. 16, 2013

(54) IMAGE FORMING DEVICE HAVING PROCESS UNIT THAT CAN BE PULLED OUT THEREOF

(75) Inventors: Junichi Hashimoto, Toyohashi (JP); Isao Kishi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 326 days.

(21) Appl. No.: 13/013,114

(22) Filed: Jan. 25, 2011

(65) Prior Publication Data

US 2011/0211867 A1 Sep. 1, 2011

(30) Foreign Application Priority Data

Feb. 26, 2010 (JP) ..... 2010-042724

(51) Int. Cl.
*G03G 15/04* (2006.01)

(52) U.S. Cl.
USPC ..... 399/119

(58) Field of Classification Search
USPC ..... 399/119, 107, 110, 111, 117, 167
See application file for complete search history.

(56) References Cited

U.S. PATENT DOCUMENTS

| | | | | |
|---|---|---|---|---|
| 7,242,890 | B2 | 7/2007 | Yokota | |
| 7,715,756 | B2 | 5/2010 | Hattori | |
| 7,954,812 | B2 | 6/2011 | Shimmachi et al. | |
| 2005/0260010 | A1 | 11/2005 | Yokota | |
| 2007/0147887 | A1 | 6/2007 | Hattori | |
| 2007/0177899 | A1 * | 8/2007 | Kawamura | 399/223 |
| 2008/0205911 | A1 | 8/2008 | Ishikawa et al. | |
| 2008/0223173 | A1 | 9/2008 | Ishikawa | |
| 2009/0129812 | A1 | 5/2009 | Kawanami et al. | |
| 2009/0220273 | A1 | 9/2009 | Tomatsu | |
| 2009/0302520 | A1 | 12/2009 | Shimmachi et al. | |

FOREIGN PATENT DOCUMENTS

| | | | |
|---|---|---|---|
| JP | 2005055749 | A | 3/2005 |
| JP | 2005274965 | A | 10/2005 |
| JP | 2005338146 | A | 12/2005 |
| JP | 2007178656 | A | 7/2007 |
| JP | 2008191290 | A | 8/2008 |
| JP | 2008-216393 | | 9/2008 |
| JP | 2009128506 | A | 6/2009 |
| JP | 2009-210631 | | 9/2009 |
| JP | 2009296530 | A | 12/2009 |

OTHER PUBLICATIONS

Decision to Grant for Japanese patent application No. 2010-042724 mailed Mar. 21, 2012.

* cited by examiner

*Primary Examiner* — Walter L Lindsay, Jr.
*Assistant Examiner* — Billy J Lactaoen
(74) *Attorney, Agent, or Firm* — Banner & Witcoff, Ltd.

(57) ABSTRACT

The process unit includes a casing, a developer unit, and a switching unit. The developer unit is movable between an image-forming position and a detached position. The developer unit includes a drive force input unit and a drive force transmitting unit. A drive force is inputted into the drive force input unit from outside of the developer unit. The drive force transmitting unit transmits the drive force. The switching member is for switching the drive force transmitting unit between a transmitting state and an interrupting state. The switching member switches the drive force transmitting unit to the transmitting state when the developer unit is at the image-forming position, and the switching member switches the drive force transmitting unit to the interrupting state when the developer unit is at the detached position.

10 Claims, 9 Drawing Sheets

IMAGE FORMING DEVICE HAVING PROCESS UNIT THAT CAN BE PULLED OUT THEREOF

CROSS REFERENCE TO RELATED APPLICATION

This application claims priority from Japanese Patent Application No. 2010-042724 filed Feb. 26, 2010. The entire content of this priority application is incorporated herein by reference.

TECHNICAL FIELD

The present invention relates to a process unit provided in a laser printer or other image-forming device and the image-forming device equipped with this process unit.

BACKGROUND

A tandem-type color laser printer is well known in the art as a type of electrophotographic color printer. The tandem-type color laser printer has a plurality of photosensitive drums juxtaposed in a prescribed direction and provided one for each of the toner colors yellow, magenta, cyan, and black, and a plurality of developer cartridges respectively corresponding to the photosensitive drums for supplying toner to the photosensitive drums.

One type of tandem-type color laser printer includes a main casing, a drum unit detachably provided in the main casing and provided with the photosensitive drums, and the developer cartridges provided with developing rollers and detachably mounted in the drum unit. In the color laser printer, bosses are provided on each developer cartridge, and pressing members are provided in the drum unit for pressing the bosses provided on the developer cartridge.

In order to mount the developer cartridge in the drum unit, the developer cartridge is pushed downward into the drum unit until the developing roller held in the developer cartridge contacts the corresponding photosensitive drum in the drum unit so that the developer cartridge is positioned at a detached position. Next, the developer cartridge is tilted forward so that the bosses on the developer cartridge slide underneath the pressing members and the developer cartridge is positioned at an image-forming position. At this time, the pressing members suppress the bosses, pressing the developing roller to the photosensitive drum, thereby completing the operation for mounting the developer cartridge in the drum unit.

SUMMARY

In the color laser printer described above, the developing roller is fixed in position relative to the photosensitive drum when the developer cartridge has been pushed into the drum unit and the developing roller has contacted the photosensitive drum, i.e., when the developer cartridge is positioned at the detached position.

Even if the drum unit is mounted into the main casing of the printer while the developer cartridge is at the detached position, but not at the image forming position (if the developer cartridge is not tilted forward after being inserted into the drum unit), a drive force supplied from the main casing may be inputted into the developer cartridge. When this occurs, the drive force can cause damage to the developer cartridge since the developer cartridge is not at the image forming position.

Therefore, it is an object of the present invention to provide a process unit and an image forming device capable of preventing damage to the developer cartridge when the drive force is inputted into the developer cartridge while the developer cartridge is at the detached position (i.e., not fully mounted).

In order to attain the above and other objects, the invention provides a process unit. The process unit includes a casing, a developer unit, and a switching unit. The developer unit is detachably mounted in the casing and is movable between an image-forming position and a detached position. An image forming operation can be performed when the developer unit is at the image-forming position. The developer unit can be detached from the casing when the developer unit is at the detached position. The developer unit includes a developing member, a drive force input unit, and a drive force transmitting unit. A drive force is inputted into the drive force input unit from outside of the developer unit. The drive force transmitting unit transmits the drive force inputted into the drive force input unit. The switching member is provided on the casing for switching the drive force transmitting unit between a transmitting state in which the drive force is transmitted and an interrupting state in which transmission of the drive force is interrupted. The drive force is inputted into the drive force input unit regardless of whether the developer unit is positioned at the image-forming position or the detached position. The switching member switches the drive force transmitting unit to the transmitting state when the developer unit is at the image-forming position, and the switching member switches the drive force transmitting unit to the interrupting state when the developer unit is at the detached position.

According to another aspect, the present invention provides an image forming device. The image forming device includes a process unit and a drive source. The process unit includes a casing, a developer unit, and a switching unit. The developer unit is detachably mounted in the casing and is movable between an image-forming position and a detached position. An image forming operation can be performed when the developer unit is at the image-forming position. The developer unit can be detached from the casing when the developer unit is at the detached position. The developer unit includes a developing member, a drive force input unit, and a drive force transmitting unit. A drive force is inputted into the drive force input unit from outside of the developer unit. The drive force transmitting unit transmits the drive force inputted into the drive force input unit. The switching member is provided on the casing for switching the drive force transmitting unit between a transmitting state in which the drive force is transmitted and an interrupting state in which transmission of the drive force is interrupted. The drive force is inputted into the drive force input unit regardless of whether the developer unit is positioned at the image-forming position or the detached position. The switching member switches the drive force transmitting unit to the transmitting state when the developer unit is at the image-forming position, and the switching member switches the drive force transmitting unit to the interrupting state when the developer unit is at the detached position. The drive source inputs the drive force to the drive force input unit.

BRIEF DESCRIPTION OF THE DRAWINGS

The particular features and advantages of the invention as well as other objects will become apparent from the following description taken in connection with the accompanying drawings, in which:

FIG. 3(*b*) is a cross sectional view of the process unit, taken along a line III-III in FIG. 2;

FIG. 4(*b*) is a perspective view showing the developer cartridge from which a gear cover is detached;

FIG. 5(*b*) is a diagram explaining the detached position of the developer cartridge as viewed from upper right;

FIG. 7(*b*) is a diagram explaining the image-forming position of the developer cartridge as viewed from upper right;

FIG. 9(*b*) is a diagram explaining disengagement between the detection gear and the agitator gear when the developer cartridge according to the modification of the invention is at the detached position.

DETAILED DESCRIPTION

Figure 1:
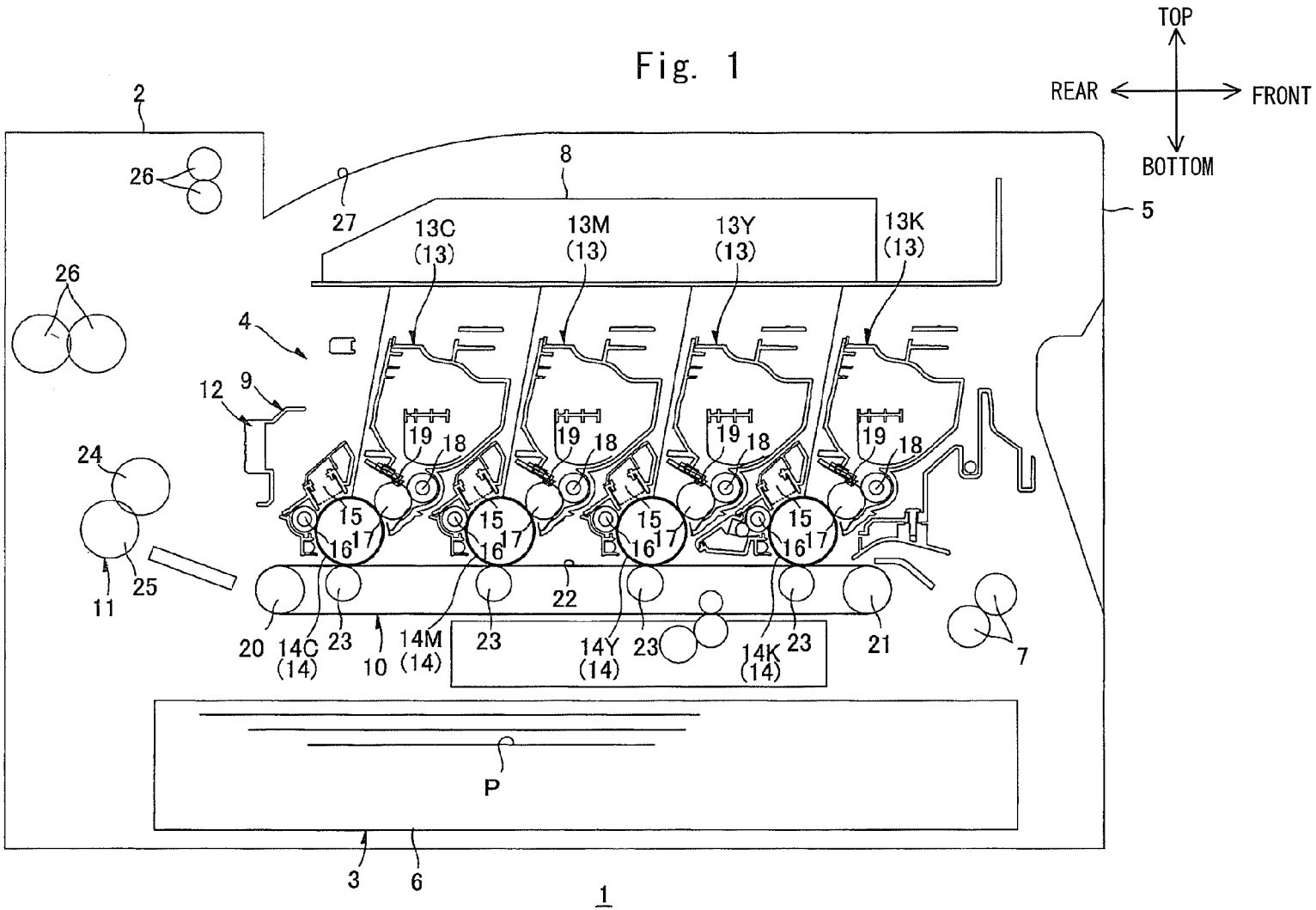
FIG. 1 is a cross-sectional view showing a color laser printer according to a preferred embodiment of the present invention.

1. Overall Structure of a Color Laser Printer

The color laser printer 1 is a direct tandem color laser printer of a horizontal type, whereby photosensitive drums for forming individual colors are juxtaposed horizontally in a tandem arrangement. The color laser printer 1 includes a main casing 2, a sheet-feeding unit 3 provided in the main casing 2 for feeding sheets of a paper P to be printed, and an image-forming unit 4 for forming images on the paper P supplied by the sheet-feeding unit 3.

(1) Main Casing

The main casing 2 has a substantially rectangular box shape in a side view for accommodating the sheet-feeding unit 3 and the image-forming unit 4. A front cover 5 is provided on one side wall of the main casing 2. The front cover 5 is capable of pivoting relative to the main casing 2 about its lower end and, thus, can be opened to allow mounting and removing a process unit 9 described later.

In the following description, the side of the main casing 2 on which the front cover 5 is provided (the right side in FIG. 1) will be called the "front side," and the opposite side (the left side in FIG. 1) will be called the "rear side." Further, the left and right sides of the main casing 2 will be based on the perspective of an operator looking at the printer 1 from the front side. In other words, the near side in FIG. 1 will be the "left side," while the far side in FIG. 1 will be the "right side."

(2) Sheet-Feeding Unit

The sheet-feeding unit 3 includes a paper tray 6 for accommodating paper P. The paper tray 6 is detachably mounted in the bottom section of the main casing 2. A pair of registration rollers 7 is disposed above the front end of the paper tray 6.

The paper P accommodated in the paper tray 6 are fed toward the registration rollers 7 one sheet at a time, and the registration rollers 7 convey the paper P toward the image-forming unit 4 (between photosensitive drums 14 and a conveying belt 22 described later) at a prescribed timing.

(3) Image-Forming Unit

The image-forming unit 4 includes a scanning unit 8, the process unit 9, a transfer unit 10, and a fixing unit 11.

(3-1) Scanning Unit

The scanning unit 8 is disposed in the top section of the main casing 2. As indicated by solid lines in FIG. 1, the scanning unit 8 irradiates laser beams toward four photosensitive drums 14, described later, based on image data for selectively exposing the photosensitive drums 14.

(3-2) Process Unit (3-2-1) Structure of the Process Unit

The process unit 9 is disposed in the main casing 2 below the scanning unit 8 and above the transfer unit 10. The process unit 9 includes a process frame 12, and four developer cartridges 13 provided for each of the four printing colors. The process unit 9 can be mounted in and removed from the main casing 2 by sliding in the front-to-rear direction.

The process frame 12 is disposed in the main casing 2 and can be pulled out of the main casing 2 in a forwardly direction. The process frame 12 retains the photosensitive drums 14, Scorotron chargers 15, and drum cleaning rollers 16.

The four photosensitive drums 14 are arranged parallel to each other with their axes extending in the left-to-right direction and are spaced at intervals in the front-to-rear direction. The photosensitive drums 14 specifically include, in order from front to rear, a black photosensitive drum 14K, a yellow photosensitive drum 14Y, a magenta photosensitive drum 14M, and a cyan photosensitive drum 14C.

The Scorotron chargers 15 are positioned diagonally above and rearward of the respective photosensitive drums 14. The Scorotron chargers 15 face the respective photosensitive drums 14 but are separated therefrom.

The drum cleaning rollers 16 are disposed on the rear side of the respective photosensitive drums 14, confronting and contacting the same.

Each of the developer cartridges 13 is removably mounted in the process frame 12 above corresponding photosensitive drum 14 so as to confront the photosensitive drum 14. The developer cartridges 13 specifically include, in order from front to rear, a black developer cartridge 13K, a yellow developer cartridge 13Y, a magenta developer cartridge 13M, and a cyan developer cartridge 13C. Each of the developer cartridges 13 is also provided with a developing roller 17.

Figure 4A:
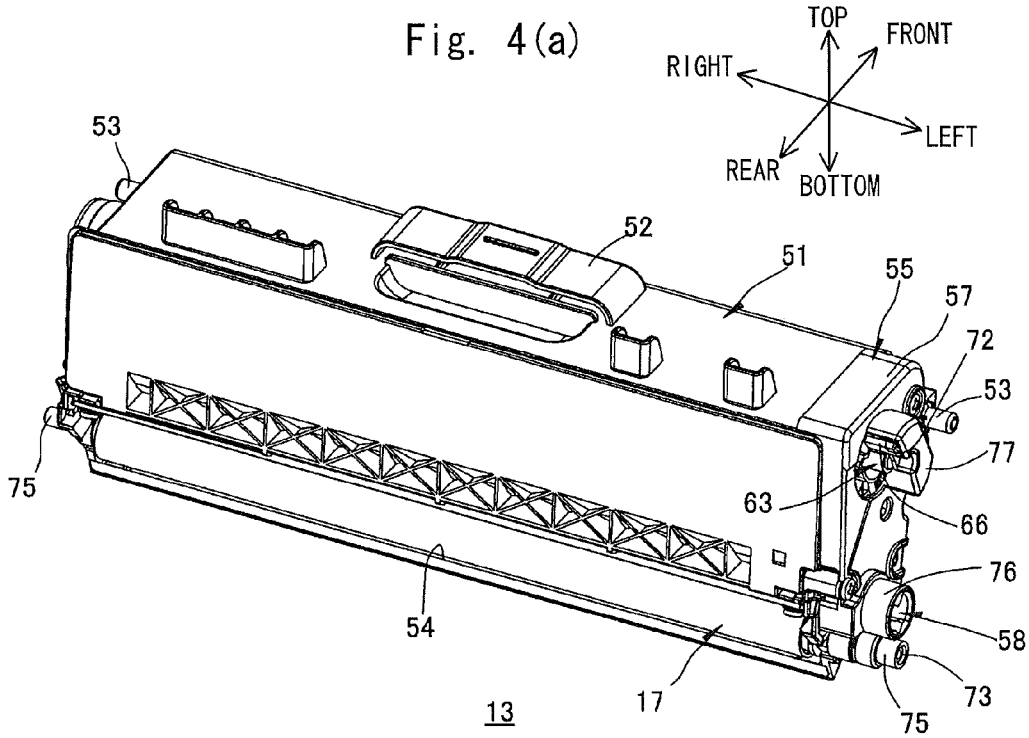
FIG. 4(*a*) is a perspective view showing a developer cartridge as viewed from upper left.
Figure 4B:
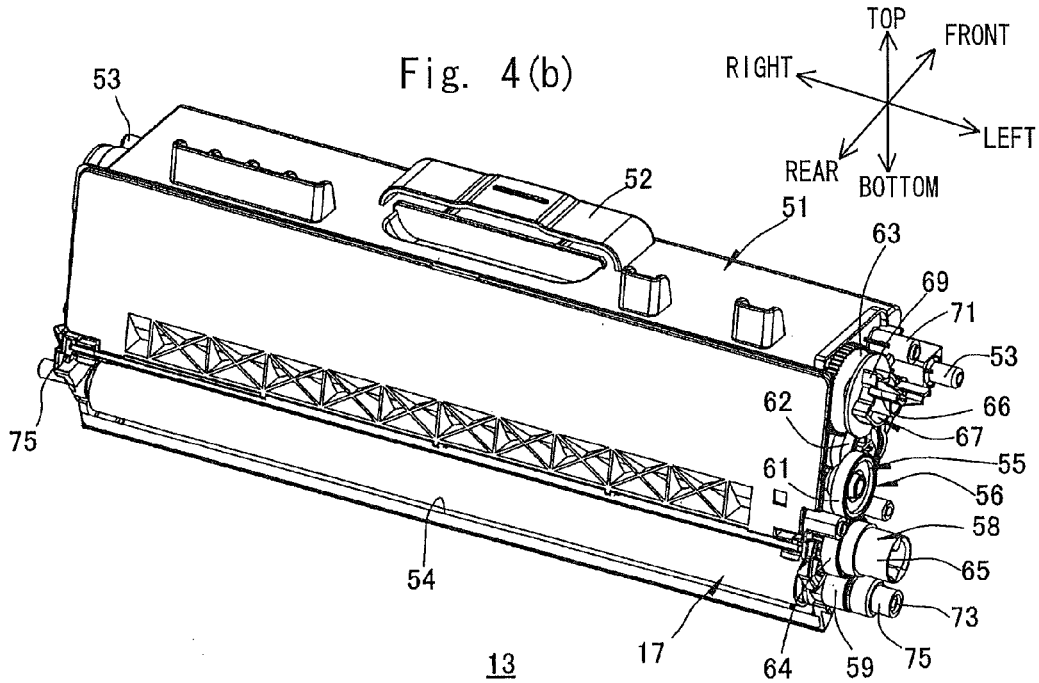

As will be described later, the developing roller 17 is rotatably supported in the lower end of the developer cartridge 13 so that the peripheral surface of the developing roller 17 is exposed on the rear side (FIG. 4). The developing roller 17 opposes and contacts the upper front edge of the corresponding photosensitive drum 14 (FIG. 1).

Each developer cartridge 13 further includes a supply roller 18 for supplying toner to the developing roller 17 and a thickness-regulating blade 19 for regulating the layer thickness of toner supplied to the developing roller 17. The developer cartridge 13 also has an interior space in the upper section for accommodating the toner of a corresponding color.

(3-2-2) Developing Operations of the Process Unit

The toner accommodated in the developer cartridge 13 is supplied onto the supply roller 18, and the supply roller 18 in turn supplies the toner to the developing roller 17. The toner is positively tribocharged between the supply roller 18 and the developing, roller 17.

As the developing roller 17 rotates, the thickness-regulating blade 19 regulates the thickness of the toner supplied to the developing roller 17 so that the developing roller 17 carries a uniform thin layer of the toner on the surface thereof.

In the meantime, the Scorotron charger 15 applies a uniform positive charge to the surface of the photosensitive drum 14 as the photosensitive drum 14 rotates. Subsequently, the scanning unit 8 irradiates laser beams (indicated by solid lines in FIG. 1), exposing the surfaces of the respective photosensitive drums 14 in a high-speed scan to form electrostatic latent images on the surfaces of the photosensitive drums 14 corresponding to an image to be formed on the paper P.

As the photosensitive drum 14 continues to rotate, the positively charged toner carried on the surface of the developing roller 17 is supplied to the electrostatic latent image formed on the surface of the photosensitive drum 14. The toner develops the latent image into a visible toner image by reversal.

(3-3) Transfer Unit

The transfer unit 10 is disposed inside the main casing 2 above the sheet-feeding unit 3 and below the process unit 9. The transfer unit 10 extends in the front-to-rear direction. The transfer unit 10 includes a drive roller 20, a follow roller 21, the conveying belt 22, and four transfer rollers 23.

The drive roller 20 and the follow roller 21 are disposed in parallel to each other and separated in the front-to-rear direction.

The conveying belt 22 is looped around the drive roller 20 and the follow roller 21 and is positioned so that an upper portion of the conveying belt 22 confronts and contacts each of the photosensitive drums 14 from above. When the drive roller 20 is driven to rotate, the conveying belt 22 circulates so that the upper portion in contact with the photosensitive drums 14 moves rearward.

Each of the transfer rollers 23 is disposed within the inner space defined by the conveying belt 22 at a position opposing the corresponding photosensitive drum 14 through the upper portion. The position between each photosensitive drum 14 and the corresponding transfer roller 23 will be called a "transfer position."

When the paper P is supplied from the sheet-feeding unit 3 onto the conveying belt 22, the conveying belt 22 conveys the paper P rearward so that the paper P passes sequentially through the transfer positions between the photosensitive drums 14 and the respective transfer rollers 23. As the conveying belt 22 conveys the paper P, toner images of the respective colors are sequentially transferred from the photosensitive drum 14 onto the paper P to form a color image thereon.

In some cases, toner remains on the surface of the photosensitive drum 14 after the toner image has been transferred from the photosensitive drum 14 to the paper P. This residual waste toner is transferred to the corresponding drum cleaning roller 16 by a cleaning bias applied to the drum cleaning roller 16 when the waste toner carried on the rotating photosensitive drum 14 opposes the drum cleaning roller 16, and the drum cleaning roller 16 retains the waste toner.

(3-4) Fixing Unit

The fixing unit 11 is positioned on the rear side of the transfer unit 10. The fixing unit 11 includes a heating roller 24 and a pressure roller 25 disposed in confrontation with the heating roller 24. After the color image is transferred onto the paper P, the color image is fixed to the paper P by heat and pressure as the paper P passes between the heating roller 24 and the pressure roller 25 in the fixing unit 11.

(4) Sheet Discharge

A U-shaped conveying path is formed in the main casing 2 on the downstream side of the fixing unit 11 in the sheet conveying direction and leads from the fixing unit 11 to a sheet-discharge tray 27 formed above the scanning unit 8. Pairs of discharge rollers 26 are provided along the U-shaped path. After the toner image has been fixed to the conveying paper P in the fixing unit 11, the discharge rollers 26 convey the paper P along the U-shaped conveying path and discharge the paper P onto the sheet-discharge tray 27.

2. Detailed Description of the Process Unit (1) Process Frame

Figure 2:
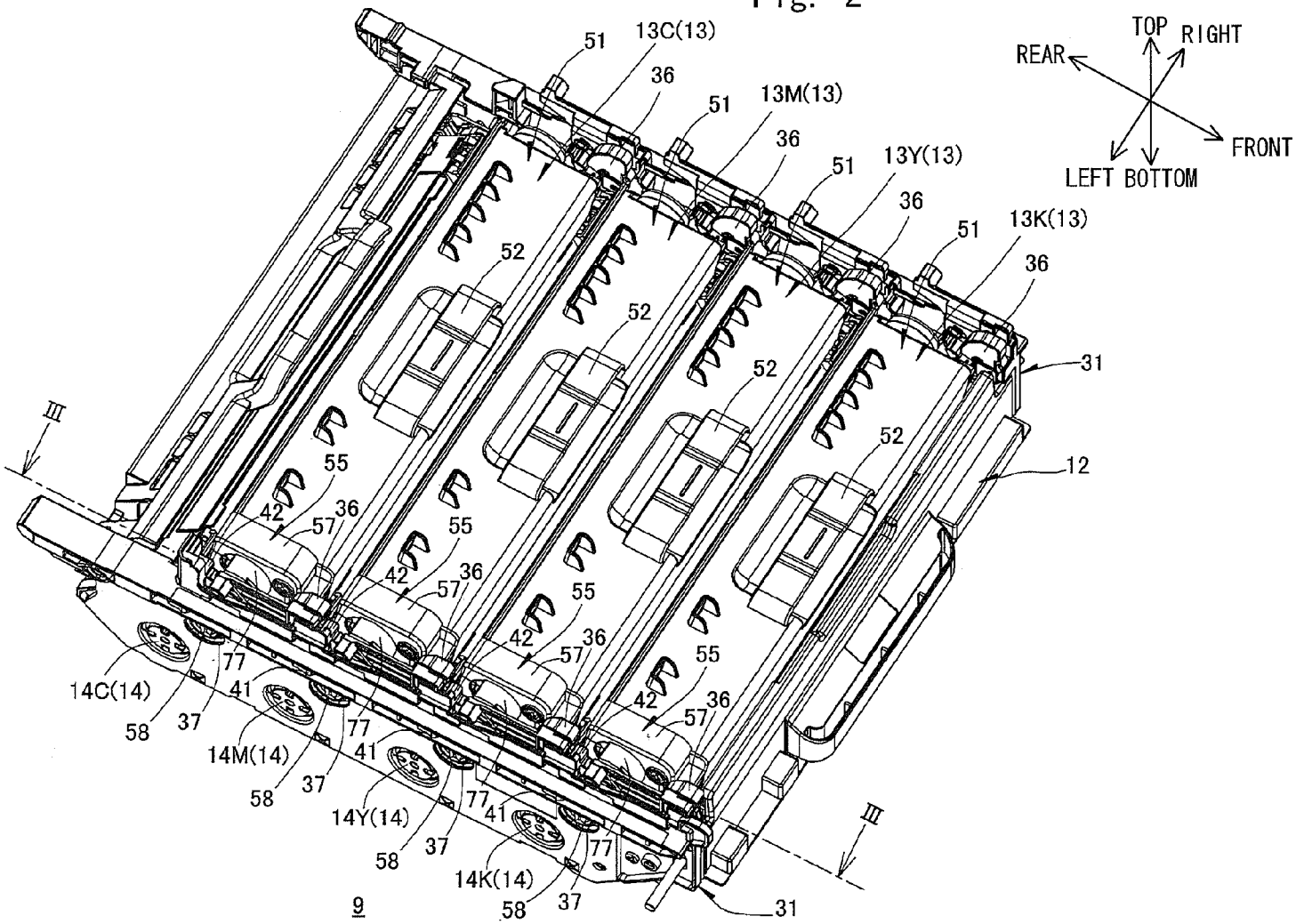
FIG. 2 is a perspective view showing a process unit as viewed from upper left.

As shown in FIG. 2, the process frame 12 has a substantially rectangular frame-like shape elongated in the front-to-rear direction in a plan view. The process frame 12 is provided with a pair of left and right side plates 31.

Figure 3A:
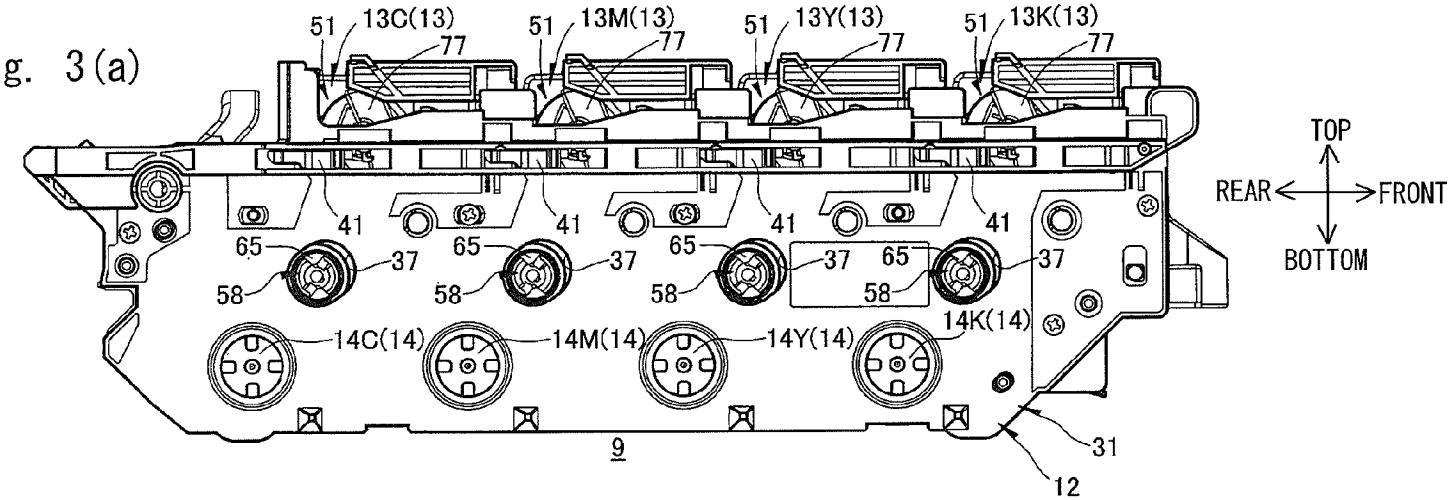
FIG. 3(*a*) is a left side view of the process unit.
Figure 3B:
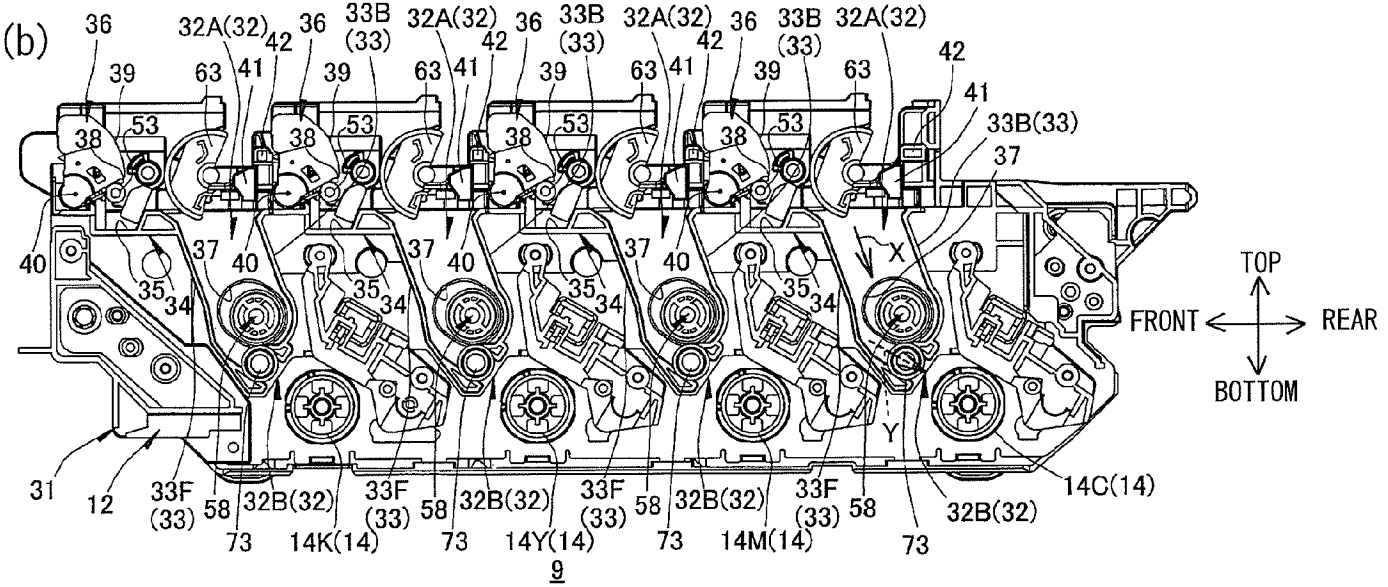

The left and right side plates 31 are arranged parallel to each other and separated in the left-to-right direction. As illustrated in FIGS. 3(*a*) and 3(*b*), both left and right side plates 31 are formed in a substantially rectangular shape elongated in the front-to-rear direction.

Each of the left and right side plates 31 has four guide grooves 32 (FIG. 3(*b*)) formed therein.

In the preferred embodiment, a construction related to a process-side actuator 41 described later and a switching boss 42 described later is provided only for the left side plate 31. Below, the left side plate 31 will be described in detail, while a description of the right side plate 31 will be omitted. In the following description, the left side plate 31 will simply be referred to as the "side plate 31."

The four guide grooves 32 evenly spaced in the front-to-rear direction are formed in the right surface (inner surface with respect to the left-to-right direction) of the side plate 31 and respectively corresponding to the photosensitive drums 14. Each of the guide grooves 32 extends downward from the upper edge of the side plate 31 in a rearward sloping direction, i.e., in a first sloping direction X indicated by a solid arrow in FIG. 3(*b*), and is substantially U-shaped with the top portion open in the upper edge of the side plate 31. The guide groove 32 is formed on the upper front side of the corresponding photosensitive drum 14.

More specifically, four pairs of guide ribs 33 are formed on the right surface of the side plate 31 for defining the respective guide grooves 32. Each pair of individual guide ribs 33 includes a front rib 33F on the front side and back rib 33B on the rear side.

The guide ribs 33 are separated from each other in the front-to-rear direction and extend along the first sloping direction X while protruding outward toward the right. The lower ends of the guide ribs 33 are opposite to and away from the corresponding photosensitive drum 14 by a small gap.

The front rib 33F extends from the upper edge of the side plate 31 in a substantially straight line along the first sloping direction X, and then curves rearward and extends in a second direction Y indicated by a dotted arrow in FIG. 3(*b*), which is a direction following a radial direction of the photosensitive drum 14.

The back rib 33B extends from the upper edge of the side plate 31 in a substantially straight line along the first sloping direction X, and then protrudes rearward in an arc shape so as to slightly increase the width of the guide groove 32 (distance between the front rib 33F and the back rib 33B in the front-to-rear direction). The bottom end of the back rib 33B is opposite to the lower end of the front rib 33F with a gap therebetween that is substantially equivalent to the diameter of a developing roller shaft 73 (described later). The lower edge of the back rib 33B extends along the second sloped direction Y.

In other words, each guide groove 32 is configured of a first guide groove 32A extending from the upper edge of the side plate 31 along the first sloping direction X, and a second guide groove 32B in continuous communication with the first guide groove 32A and extending from the bottom end of the first guide groove 32A along the second sloped direction Y.

The side plate 31 is formed with a coupling hole 37 at a position between each front rib 33F and the arc-shaped part of the corresponding back rib 33B.

The coupling hole 37 is an elongated hole extending along a direction sloping downward toward the rear. Through the coupling hole 37, a coupling member 58 (described later) of the developer cartridge 13 is exposed on the left side of the side plate 31.

An extension part 34 is provided on the right surface of the side plate 31 between each pair of adjacent guide grooves 32, and also extending forward from the front side of the forwardmost guide groove 32.

Each extension part 34 extends in the front-to-rear direction and connects the top edge of the front rib 33F forming the guide groove 32 on the rear side with the top edge of the back rib 33B forming the guide groove 32 on the front side except the forwardmost extension part 34 which is connected only to the top edge of the front rib 33F forming the guide groove 32 on the rear side. A recession 35 is concave downward and is formed in the top surface of each extension part 34.

The right surface of the side plate 31 is provided with the pressing cams 36, process-side actuators 41, and the switching bosses 42.

The four pressing cams 36 are provided on the upper edge of the side plate 31 at positions corresponding to the guide grooves 32 and upwardly adjacent to the respective extension parts 34.

Each pressing cam 36 is substantially fan-shaped in a side view. Specifically, each pressing cam 36 includes a pair of flat portions 38, and a curved portion 39. The distance between the pair of flat portions 38 expands gradually in a direction upward and rearward toward the curved portion 39. The curved portion 39 connects the upper rear ends of the flat portions 38 and has a substantially arc shape that expands outward in a direction diagonally upward and rearward.

The pressing cam 36 also has a rotational shaft 40 extending outward from the pressing cam 36 in left and right directions near the area at which the lower front ends of the two flat portions 38 are joined. Right end of the rotational shaft 40 is supported in the inner surfaces of the left side plate 31, whereby the pressing cam 36 is rotatably supported about the rotational shaft 40. An urging member (not shown) is provided for urging the pressing cam 36 counterclockwise in a left-side view.

The four process-side actuators 41 are provided above the back ribs 33B and corresponding to the developer cartridges 13. Each process-side actuator 41 is substantially rod-shaped and is rotatably disposed on the side plate 31 so that one end of the process-side actuator 41 protrudes rightward from the right surface of the side plate 31 (FIGS. 3(*b*) and 7(*b*)), while the other end of the process-side actuator 41 is exposed on the left side of the side plate 31 (FIG. 3(*a*)). When the one end of the process-side actuator 41 is contacted by a detection gear 63 (FIG. 3(*b*), described later) of the developer cartridge 13, the process-side actuator 41 rotates, causing the other end of the process-side actuator 41 to protrude from the left surface of the side plate 31.

The four switching bosses 42 are provided on the side plate 31 above the process-side actuators 41 and corresponding to the developer cartridges 13 (FIG. 3(*b*)). Each switching boss 42 is formed substantially like a square column that protrudes outward from the right surface of the side plate 31. The switching boss 42 is disposed farther rearward than the one end of the corresponding process-side actuator 41 so as not to interfere with the detection gear 63 (described later) of the developer cartridge 13 when the developer cartridge 13 is at an image-forming position (described later) and so as to interfere with the detection gear 63 when the developer cartridge 13 is at a detached position (described later).

(2) Developer Cartridge

As shown in FIGS. 1 and 4(*a*), each developer cartridge 13 includes a frame 51, in addition to the developing roller 17 and the supply roller 18 described above.

The frame 51 has a box shape elongated in the left-to-right direction. In a side view, the frame 51 is shaped substantially like an isosceles triangle with a vertex pointing diagonally downward and rearward.

A handle 52 and a pair of left and right bosses 53 are provided in the top front portion of the frame 51. An opening 54 is formed in the bottom rear side of the frame 51.

The handle 52 is disposed in the left-to-right center of the frame 51 and is elongated in the left-to-right direction. The handle 52 is formed to protrude upward from the top edge of the frame 51.

The bosses 53 are substantially cylindrical in shape and protrude outward in the left and right directions from the respective left and right endfaces of the frame 51. The opening 54 is formed across the entire left-to-right dimension of the frame 51, opening toward the rear. The frame 51 is also provided with a drive unit 55.

As shown in FIGS. 4(*a*) and 4(*b*), the drive unit 55 is disposed on the left end of the frame 51 and includes the coupling member 58, a detection gear 56, and a gear cover 57.

The coupling member 58 is a female coupling member having a substantially cylindrical shape. The coupling member 58 is rotatably provided on the lower rear end of the developer cartridge 13. As shown in FIG. 4(*b*), the coupling member 58 is integrally configured of a large-diameter gear part 64 and a small-diameter coupling part 65 extending coaxially from the left side of the large-diameter gear part 64.

When the developer cartridge 13 is mounted in the main casing 2, a male coupling member (not shown) provided in the main casing 2 couples with the left end of the small-diameter coupling part 65 from the left side thereof. Through this coupling, a motor 81 (described later with reference to FIGS. 6 and 8) provided in the main casing 2 can input a drive force to the small-diameter coupling part 65.

As shown in FIGS. 4(*b*) and 7(*a*), the gear train 56 includes an idler gear 61, an agitator gear 62, and the detection gear 63. The idler gear 61 is disposed above the coupling member 58. The idler gear 61 is a two-stage gear formed integrally of a large diameter part on the outside and a small-diameter part on the inside (FIG. 4(*b*)). The large diameter part is engaged with the coupling member 58 from above.

The agitator gear 62 is disposed slightly above and forward of the idler gear 61 and is engaged with the small-diameter part of the idler gear 61 on the top front side. The agitator gear 62 is fixedly provided on the left end of a rotational shaft of an agitator (not shown) serving to agitate the toner in the developer cartridge 13 and is not capable of rotating relative to the rotational shaft.

Figure 7A:
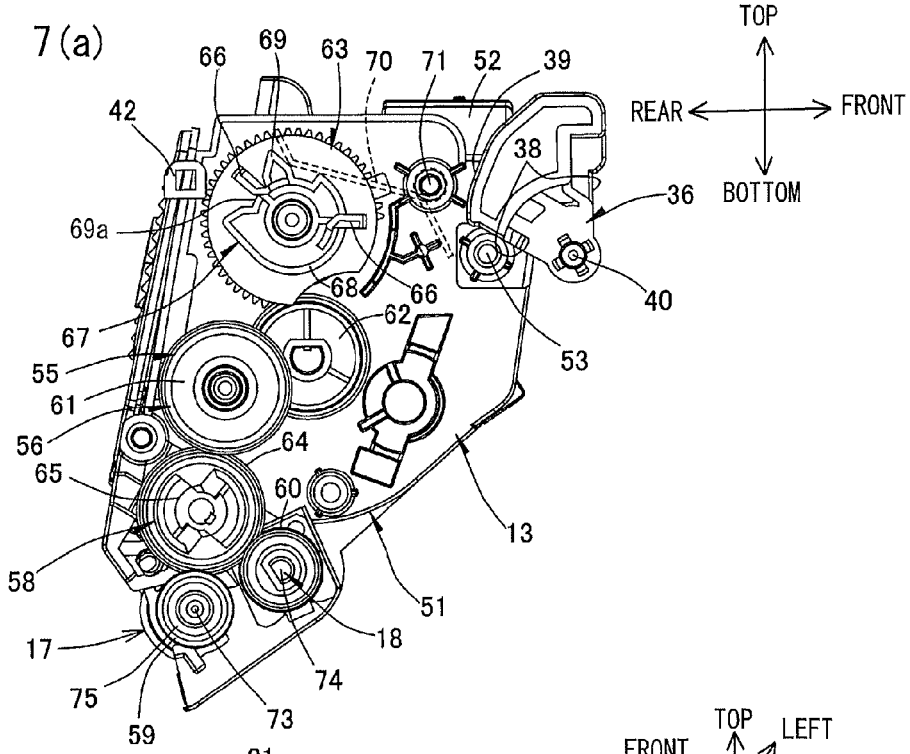
FIG. 7(*a*) is a diagram explaining an image-forming position of the developer cartridge as viewed from left.
Figure 7B:
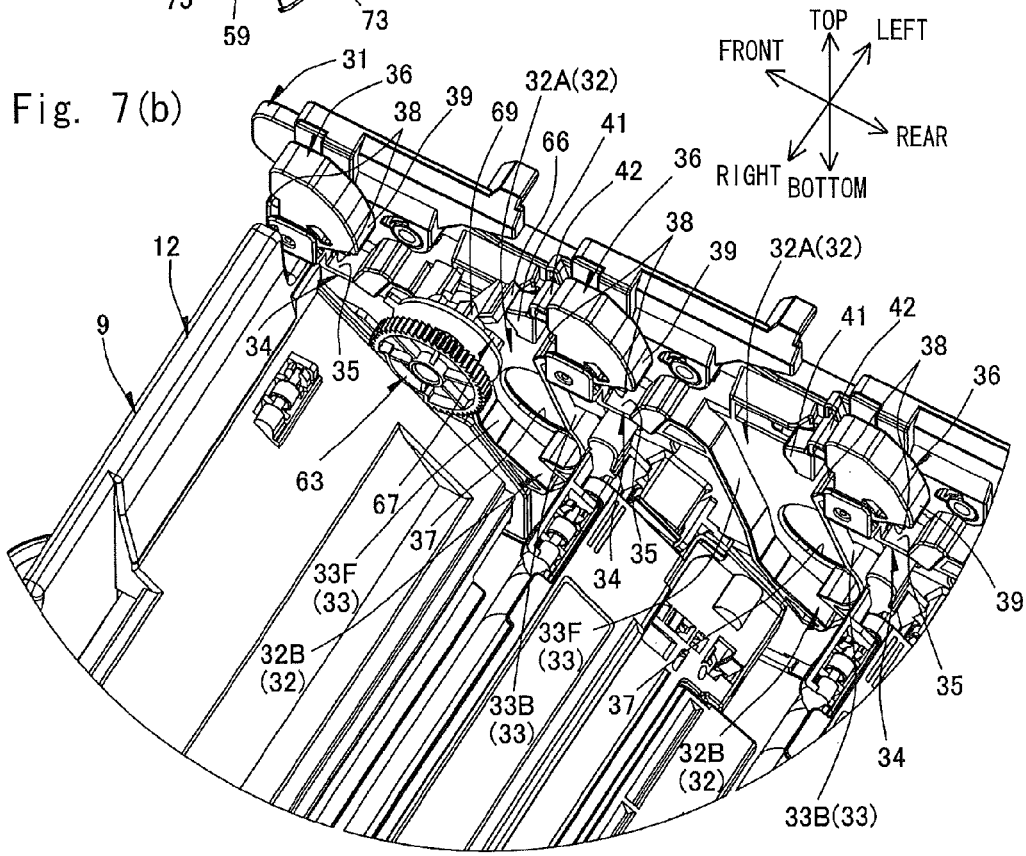

The detection gear 63 is a sector gear disposed above the agitator gear 62 (FIG. 7(*a*)). More specifically, the detection gear 63 has gear teeth on approximately four-fifths of its circumference and no teeth on the remaining approximately one-fifth. The detection gear 63 is provided with a support part 67 and two contact parts 66.

The support part 67 is a substantially cylindrical shape and protrudes leftward from the left surface of the detection gear 63 (FIG. 4(*b*)). As shown in FIG. 7(*a*), the support part 67 includes an arc-shaped part 68, a corner part 69, and a recess part 69*a*. The arc-shaped part 68 is a substantially semicircular shape and centered on the rotational axis of the detection gear 63. The corner part 69 connects one end of the arc-shaped part 68 and protrudes outward along the radial direction of the detection gear 63 opposite to the toothless region of the detection gear 63. The recess part 69*a* connects the other end of the arc-shaped part 68 and is depressed inwardly in the radial direction.

Each contact part 66 is substantially plate-shaped, extends radially outward from the approximate radial center of the detection gear 63, and protrudes leftward from the left edge of the support part 67. The contact parts 66 are positioned on opposing sides of the corner part 69 approximately 120 degrees apart in the circumferential direction of the detection gear 63. The number and shape of the contact parts 66 corresponds to information about the developer cartridge 13 (information indicating whether the developer cartridge is new, the number of sheets that can be printed with the developer cartridge, etc.).

The detection gear 63 is rotatably provided on the frame 51, with the corner part 69 pointing upward and the toothless region of the detection gear 63 facing downward.

The drive unit 55 is further provided with a coil spring 70 as shown in FIG. 7(*a*). The coil spring 70 is wound about a support boss 71 that protrudes leftward from the left side of the frame 51, with one end fixed to the left wall of the frame 51 and the other end contacting the corner part 69 from the upper front side. With this construction, the coil spring 70 urges the detection gear 63 counterclockwise in a left-side view.

Consequently, the detection gear 63 is normally engaged with the agitator gear 62 through the gear teeth formed farther rearward than the toothless region in a left-side view. Accordingly, the gear train 56 is maintained in a transmitting state in which the drive force inputted into the small-diameter coupling part 65 of the coupling member 58 can be transmitted to the detection gear 63.

As shown in FIG. 4(*a*), the gear cover 57 includes a coupling cover 76*x* and a detection gear cover 77. The coupling cover 76 has a substantially cylindrical shape and extends leftward from the left surface of the gear cover 57 near the lower edge thereof for encircling the coupling member 58.

The detection gear cover 77 is semicylindrical in shape and extends leftward from the left surface of the gear cover 57 for accommodating the detection gear 63. In a side view, the detection gear cover 77 is substantially semicircular in shape and is closed on its endface. An exposure opening 72 is formed in the rear portion of the detection gear cover 77 for exposing the contact protrusion 66.

The developing roller 17 is disposed in the lower end of the frame 51, with its axis extending in the left-to-right direction. The rear circumferential surface of the developing roller 17 is exposed through the opening 54. The developing roller 17 also includes the developing roller shaft 73. Collar members 75 are fitted over each of the left and right ends of the developing roller shaft 73.

The developing roller shaft 73 is inserted through the developing roller 17 in the left-to-right direction and serves as the axial center of the developing roller 17. A developing roller drive gear 59 is fixedly provided on the left end of the developing roller shaft 73 and cannot rotate relative to the developing roller shaft 73. Collar members 75 are provided on both left and right ends of the developing roller shaft 73.

The collar members 75 are a substantially cylindrical shape and elongated in the left-to-right direction. The inner diameter of the collar members 75 is formed slightly larger than the outer diameter of the developing roller shaft 73. The collar members 75 are fitted over the ends of the developing roller shaft 73.

As shown in FIG. 1, the supply roller 18 is disposed diagonally above and forward of the developing roller 17 and contacts the top front circumferential portion of the developing roller 17. The supply roller 18 is also provided with a supply roller shaft 74 (FIG. 7(*a*)).

The supply roller shaft 74 is inserted through the supply roller 18 in the left-to-right direction and serves as the axial center of the supply roller 18. A supply roller gear 60 is fixedly provided on the left end of the supply roller shaft 74 and cannot rotate relative to the supply roller shaft 74.

As shown in FIG. 4(*b*), the developing roller 17 is rotatably supported in the frame 51 by rotatably supporting the left end of the developing roller shaft 73 in the left side of the frame 51 and by rotatably supporting the right end of the developing roller shaft 73 in the right side of the frame 51. The developing roller drive gear 59 is engaged with the large-diameter gear part 64 of the coupling member 58 from below.

The supply roller 18 is rotatably supported in the frame 51 by rotatably supporting the left end of the supply roller shaft 74 in the left side of the frame 51 and by rotatably supporting the right end of the supply roller shaft 74 in the right side of the frame 51. The supply roller gear 60 is engaged with the large-diameter gear part 64 of the coupling member 58 from the lower front side thereof (FIG. 7(*a*)).

(1) Mounting and Removal of Developer Cartridges Relative to the Process Unit

In order to mount the developer cartridges 13 in the main casing 2, the developer cartridges 13 are first mounted in the process frame 12 as shown in FIG. 2.

To mount the developer cartridge 13 in the process frame 12, the operator first grips the handle 52 of the developer cartridge 13 and positions the developer cartridge 13 above the process frame 12, which has been pulled out from the main casing 2, so as to be aligned with the corresponding photosensitive drum 14 in the front-to-rear direction.

Next, the operator lowers the developer cartridge 13 into the process frame 12.

As the developer cartridge 13 is inserted into the process frame 12, the left end of the developing roller shaft 73 is fitted into the top portion of the first guide groove 32A formed in the left side plate 31 and the right end of the developing roller shaft 73 is fitted into the top portion of the first guide groove 32A formed in the right side plate 31.

As the left and right ends of the developing roller shaft 73 are guided along the first guide grooves 32A of the guide grooves 32, the developer cartridge 13 is inserted into the process frame 12 along the first sloping direction X (FIG. 3(*b*)), i.e., downward along a slightly rearward slope.

After the left and right ends of the developing roller shaft 73 reach the lower ends of the first guide grooves 32A, the operator continues to insert the developer cartridge 13 into the process frame 12.

At this time, the left and right ends of the developing roller shaft 73 are guided along the second guide grooves 32B. Accordingly, the left and right ends of the developing roller shaft 73 are guided into the deepest portions of the second guide grooves 32B along the second sloped direction Y (FIG. 3(*b*)), i.e., downward along a more pronounced rearward slope.

Figure 5A:
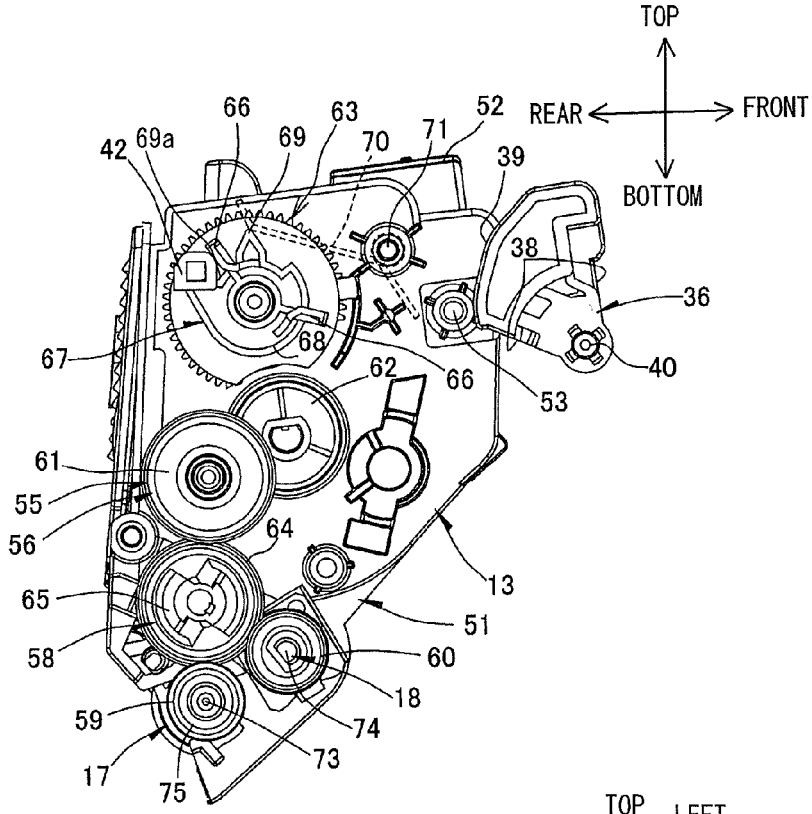
FIG. 5(*a*) is a diagram explaining a detached position of the developer cartridge as viewed from left.
Figure 5B:
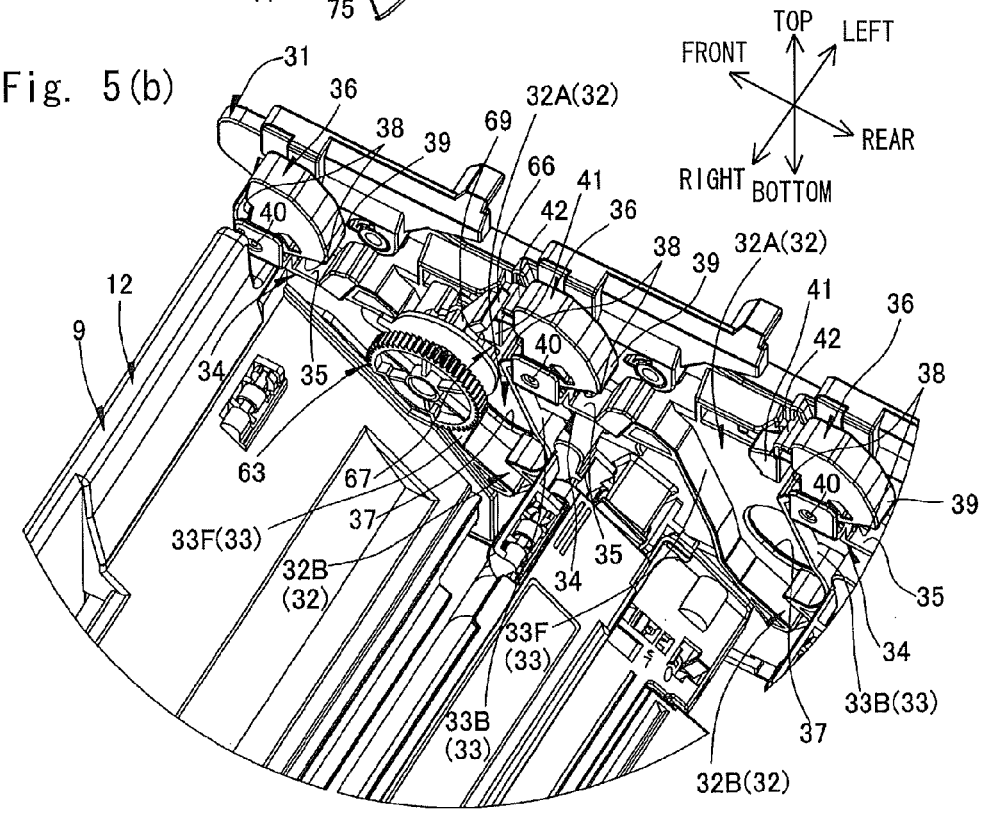

Through this operation, the developer cartridge 13 is disposed in the detached position in which the developer cartridge 13 can be removed from the process frame 12 as shown in FIG. 5(*a*).

At this time the bosses 53 are in contact with the curved portions 39 of the pressing cams 36 on the rear sides thereof. That is, through pressure applied by the curved portions 39 of the pressing cams 36 to the bosses 53, the developer cartridge 13 is held in the process frame 12 with its front end lifted in a direction upward and rearward so that the developer cartridge 13 is tilted rearward. In this state, as shown in FIG. 6, the coupling member 58 of the developer cartridge 13 is exposed through the coupling hole 37 formed in the process frame 12.

Figure 6:
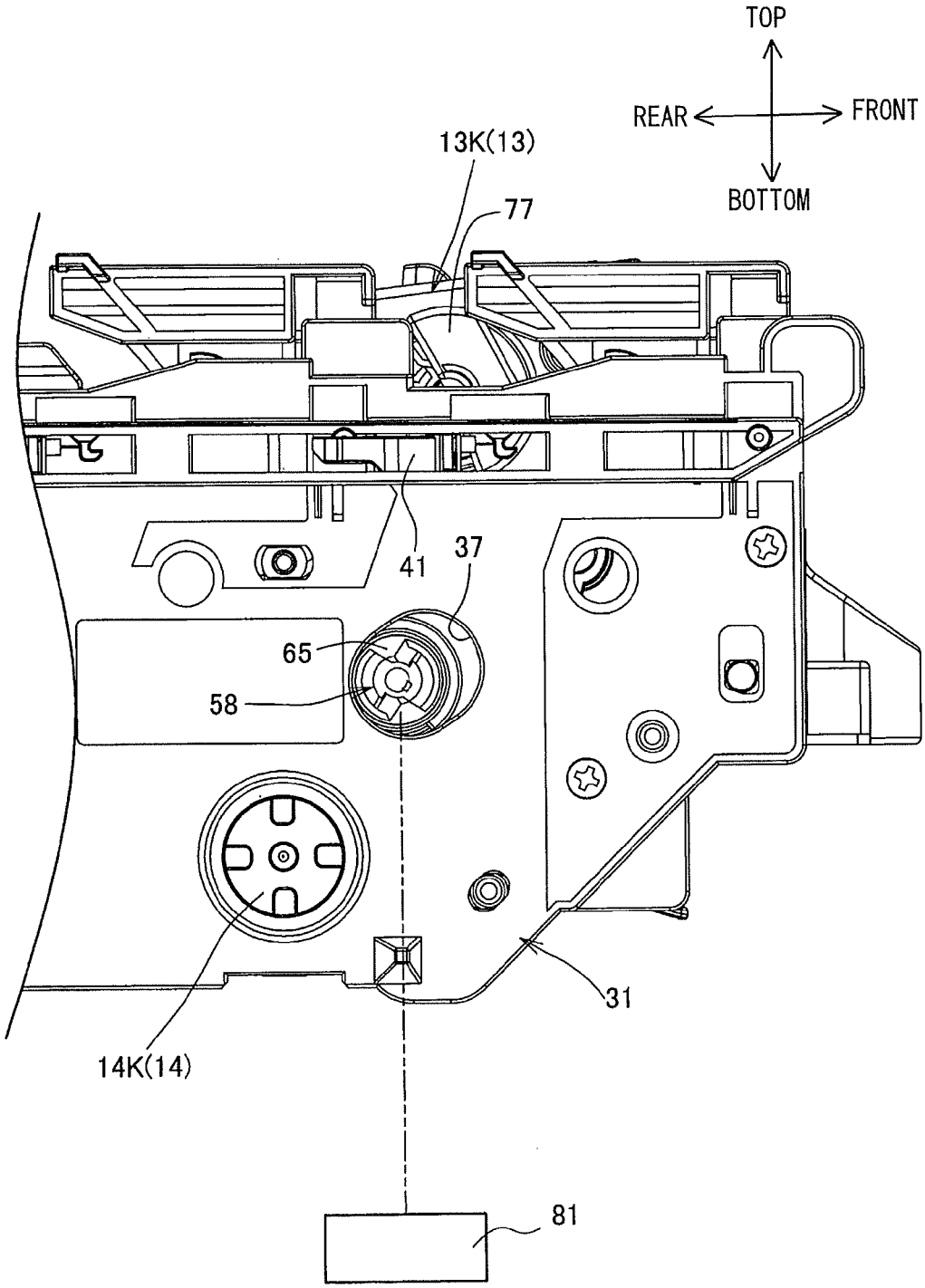
FIG. 6 is a partial side view of the process unit when the developer cartridge is at the detached position.

Hence, when the process unit 9 is mounted in the main casing 2 in this state (i.e., when the developer cartridge 13 is in the detached position), the male coupling member (not shown) of the main casing 2 is fitted into the coupling member 58, enabling the drive force from the motor 81 to be inputted into the coupling member 58, as indicated by the two-dotted chain line in FIG. 6.

At the same time, as illustrated in FIGS. 5(*a*) and 5(*b*), while the developer cartridge 13 is mounted in the process frame 12 as described above, one of the contact parts 66 of the detection gear 63 is in contact with the switching boss 42 of the process frame 12 from above.

As the developer cartridge 13 is pushed downward, the switching boss 42 applies upward pressure to the contact part 66. Consequently, the detection gear 63 rotates clockwise in a left-side view against the urging force of the coil spring 70.

When the developer cartridge 13 is in the detached position, the toothless region of the detection gear 63 is positioned opposite the agitator gear 62 so that the detection gear 63 and the agitator gear 62 are not engaged. Since the detection gear 63 and the agitator gear 62 are disengaged, the gear train 56 cannot relay the drive force between the detection gear 63 and the agitator gear 62. Hence, when the developer cartridge 13 is placed in the detached position, the gear train 56 is switched to an interrupting state in which the drive force cannot be transmitted.

Since the contact part 66 of the detection gear 63 is contacting the top of the switching boss 42 at this time, the switching boss 42 restricts the contact part 66 from contacting the process-side actuator 41 positioned lower than the switching boss 42. That is, when the developer cartridge 13 is at the detached position, the switching boss 42 is positioned between the contact part 66 and the process-side actuator 41 and prevents the contact part 66 from contacting the process-side actuator 41 (FIG. 5(*b*)).

Next, the operator pivots the developer cartridge 13 forward while gripping the handle 52.

As a result, as shown in FIG. 7(*a*), the developer cartridge 13 pivots forward about the developing roller shaft 73, and the bosses 53 push the corresponding pressing cams 36 forward and slide beneath the pressing cams 36 as the pressing cams 36 are rotated clockwise in a left-side view.

When the bosses 53 slide beneath the pressing cams 36, the pressing cams 36 engage the bosses 53 from above, and the force of urging members (not shown) pushes the bosses 53 in a direction diagonally downward and rearward.

At this time, the developer cartridge 13 is pushed by the pressing cams 36 in a direction diagonally downward and rearward, and the developing roller shaft 73 is guided by the second guide grooves 32B of the side plate 31. Thus, the developer cartridge 13 is pressed to the photosensitive drum 14 from above along the second sloped direction Y.

When the developer cartridge 13 is pivoted forward, the detection gear 63 is retracted forward from the switching boss 42, removing the contact between the detection gear 63 and the switching boss 42.

Accordingly, the urging force of the coil spring 70 rotates the detection gear 63 counterclockwise in a left-side view.

When gear teeth on the upstream side of the toothless region of the detection gear 63 with respect to the rotating direction of the detection gear 63 (counterclockwise in a left-side view) engage with the agitator gear 62, the rotation of the detection gear 63 halts.

When the detection gear 63 and the agitator gear 62 are engaged, the gear train 56 can transmit the drive force between the detection gear 63 and the agitator gear 62. Hence, when the developer cartridge 13 is placed in the image-forming position for forming images as shown in FIG. 7(*a*), the gear train 56 is switched to the transmitting state and can transmit the drive force.

Through this procedure, the developer cartridge 13 is placed in the image-forming position, and the operation for mounting the developer cartridge 13 in the process frame 12 is complete. All developer cartridges 13 are mounted in the process frame 12 according to the same procedure.

In order to remove a developer cartridge 13 from the process frame 12, the operation for mounting the developer cartridge 13 in the process frame 12 is simply reversed in order. That is, the operator first grips the handle 52 and pivots the developer cartridge 13 rearward. While still gripping the handle 52, the operator then pulls the developer cartridge 13 upward to remove the developer cartridge 13 from the process frame 12.

(2) Mounting and Removal of the Process Unit Relative to the Main Casing

Next, the process unit 9 having all developer cartridges 13 mounted in the process frame 12 is mounted in the main casing 2.

In order to mount the process unit 9 in the main casing 2, the operator inserts the process unit 9 into the main casing 2 in a rearward direction. As shown in FIG. 1, when the process unit 9 is completely inserted into the main casing 2, each of the photosensitive drums 14 contacts the upper portion of the conveying belt 22.

Next, the operator pivots the front cover 5 upward and rearward to close the front cover 5. The operation for mounting the process unit 9 in the main casing 2 is completed. To remove the process unit 9 from the main casing 2, the operator pivots the front cover 5 forward and downward and simply pulls the process unit 9 in a forward direction from the main casing 2.

(3) Drive Force Transmission

Figure 8:
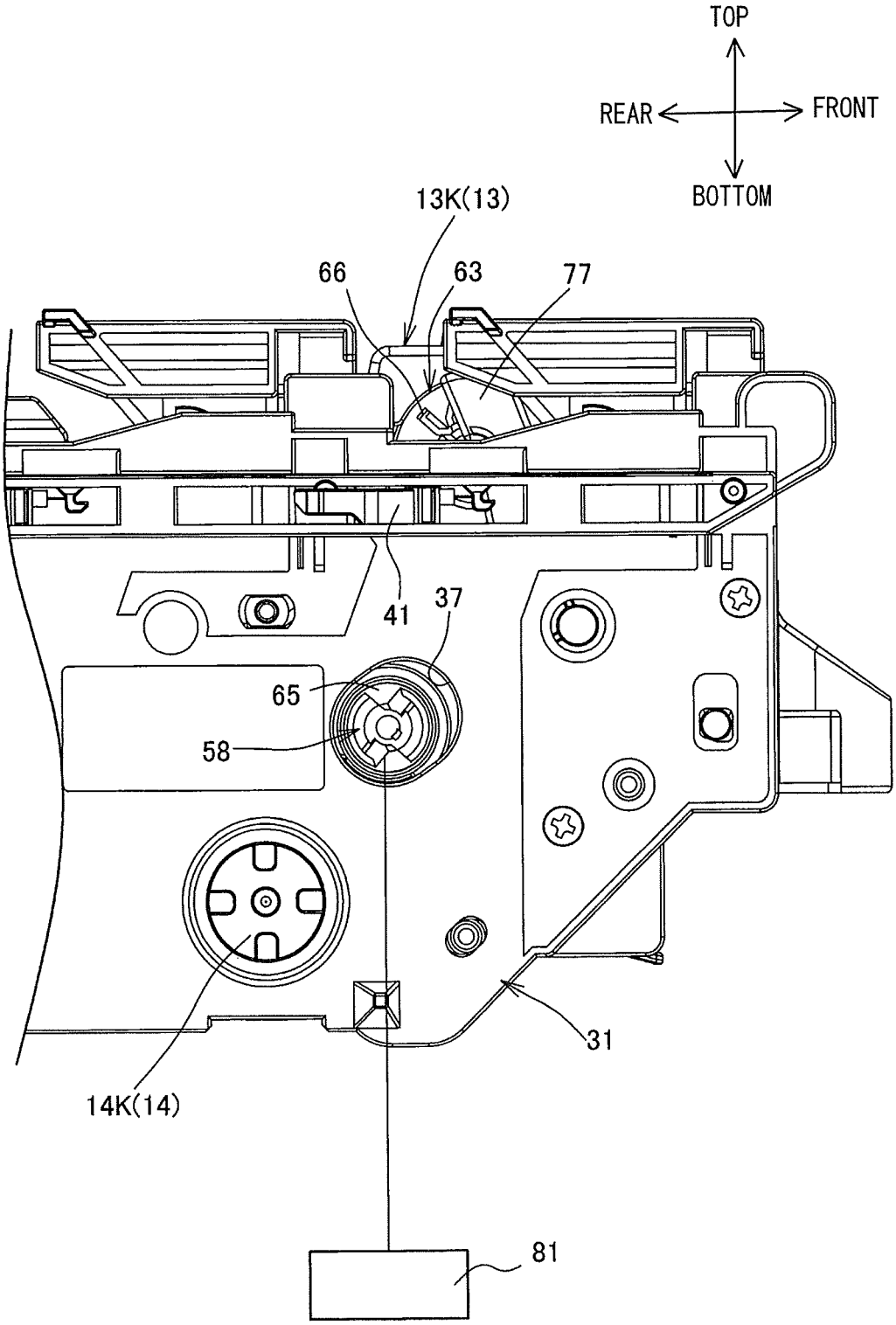
FIG. 8 is a partial side view of the process unit when the developer cartridge is at the image-forming position.

As shown in FIG. 8, when the process unit 9 is mounted in the main casing 2, the male coupling members (not shown) provided in the main casing 2 are fitted into the corresponding coupling members 58 from the left side. At this time, the motor 81 inputs the drive force into the coupling members 58 and a warming-up operation is initiated.

In the warming-up operation, the drive force inputted into the coupling member 58 is transmitted to the detection gear 63 via the idler gear 61 and the agitator gear 62 (FIG. 7(*a*)). In other words, the gear train 56 transmits the drive force inputted into the coupling member 58.

The drive force inputted into the coupling member 58 is also transmitted to the developing roller drive gear 59 and the supply roller gear 60 for rotating the developing roller 17 and the supply roller 18, respectively.

When the drive force is transmitted to the detection gear 63, the detection gear 63 rotates counterclockwise in a left-side view. As the detection gear 63 rotates, one of the contact parts 66 contact the one end of the process-side actuator 41 from above, causing the other end of the process-side actuator 41 to protrude from the process frame 12.

A photosensor (not shown) provided in the main casing 2 detects the protrusion of the process-side actuator 41, and a CPU (not shown) determines information related to the usage status of the developer cartridge 13, such as whether the developer cartridge 13 is a new cartridge and the number of sheets that can be printed by the developer cartridge 13, based on these detection results. Hence, the detection gear 63 specifies information related to the usage of the developer cartridge 13 when displaced counterclockwise in a left-side view.

After the detection gear 63 has rotated counterclockwise in a left-side view at a prescribed distance (four-fifths of a complete rotation corresponding to the periphery of the detection gear 63 with gear teeth), the toothless region of the detection gear 63 has rotated opposite the agitator gear 62, and consequently the detection gear 63 comes into a halt. At this time, the end part of the coil spring 70 is recessed in the recess part 69*a*.

If the used developer cartridge 13 is mounted in the process frame 12, the end part of the coil spring 70 is recessed in the recess part 69*a* and the toothless region of the detection gear 63 comes opposite to the agitator gear 62. Thus, the detection gear 63 does not rotate even if the agitator gear 62 rotates. The CPU determines whether the developer cartridge 13 is new based on whether the detection gear 63 has rotated after mounted in the frame 12.

4. Operations and Effects (1) With the process unit 9 of the preferred embodiment illustrated in FIGS. 5(*a*) and 7(*a*), when the developer cartridge 13 is placed in the detached position (FIG. 5(*a*)), the switching boss 42 applies pressure to the detection gear 63, disengaging the detection gear 63 from the agitator gear 62 and switching the gear train 56 of the developer cartridge 13 to the interrupting state. Further, when the developer cartridge 13 is shifted from the detached position to the image-forming position (FIG. 7(*a*)), the urging force of the coil spring 70 engages the detection gear 63 with the agitator gear 62, switching the gear train 56 of the developer cartridge 13 to the transmitting state.

Hence, when the developer cartridge 13 is in the detached position, the gear train 56 can prevent transmission of the drive force inputted into the coupling member 58 of the developer cartridge 13.

This construction can prevent damage to the developer cartridge 13 that is caused when the drive force is inputted into the coupling member 58 of the developer cartridge 13 while the developer cartridge 13 is in the detached position.

(2) With the process unit 9 according to the preferred embodiment shown in FIG. 5(*a*), the switching boss 42 applies pressure to the detection gear 63 of the gear train 56, reliably switching the gear train 56 into the interrupting state.

(3) Further, the gear train 56 can be switched to the interrupting state by rotating the detection gear 63, as shown in FIG. 5(*a*). Accordingly, the gear train 56 can be switched to the interrupting state without greatly displacing the detection gear 63.

(4) With the process unit 9 according to the preferred embodiment shown in FIG. 7(*a*), the coil spring 70 urges the detection gear 63 to engage with the agitator gear 62. Accordingly, when the pressure applied by the switching boss 42 to the detection gear 63 is removed, the urging force of the coil spring 70 engages the detection gear 63 with the agitator gear 62, switching the gear train 56 to the transmitting state. As a result, the gear train 56 can reliably be switched to the transmitting state when the pressure applied by the switching boss 42 to the detection gear 63 is removed.

(5) With the process unit 9 according to the preferred embodiment shown in FIG. 5(*a*), a plurality of gears (the idler gear 61, the agitator gear 62, and the detection gear 63) in the gear train 56 is engaged with each other for transmitting the drive force. When the switching boss 42 disengages the detection gear 63 from the agitator gear 62, the gear train 56 is switched to the interrupting state. Hence, by using the simple structure of the switching boss 42 for disengaging the detection gear 63 from the agitator gear 62, the gear train 56 can be reliably switched to the interrupting state.

(6) With the process unit 9 according to the preferred embodiment shown in FIG. 5(*a*), the switching boss 42 disengages the detection gear 63 from the agitator gear 62. Hence, transmission of the drive force to the detection gear 63 can be interrupted using a simple construction. This construction can prevent damage to the detection gear 63 when the drive force is inputted into the coupling member 58 of the developer cartridge 13 while the developer cartridge 13 is in the detached position.

(7) Further, the relative positions of the detection gear 63 provided on the developer cartridge 13 and the process-side actuator 41 provided on the process unit 9 change when the developer cartridge 13 is in the detached position (FIG. 6) and when the developer cartridge 13 is in the image-forming position (FIG. 8). Consequently, if the contact part 66 contacts the process-side actuator 41 while the developer cartridge 13 is in the detached position, the contact part 66 may press against the process-side actuator 41 in an abnormal direction and potentially cause damage to the process-side actuator 41.

However, with the process unit 9 according to the preferred embodiment shown in FIG. 5(*b*), the switching boss 42 is disposed between the contact part 66 of the detection gear 63 and the process-side actuator 41 of the process frame 12 when the developer cartridge 13 is in the detached position, preventing the contact part 66 from contacting the process-side actuator 41. Hence, this structure can reliably prevent the contact part 66 from contacting the process-side actuator 41 while the developer cartridge 13 is in the detached position and, thus, can prevent damage to the process-side actuator 41 through such contact.

(8) As shown in FIG. 1, the tandem-type process unit 9 is provided with a plurality of photosensitive drums 14 arranged parallel to each other in tandem and spaced at intervals, and the developer cartridges 13 corresponding to the photosensitive drums 14. With the structure described in the preferred embodiment, the process unit 9 can prevent damage to the developer cartridge 13 when the drive force is inputted into the coupling member 58 of the developer cartridge 13 while the developer cartridge 13 is in the detached position.

(9) Since the color laser printer 1 according to the preferred embodiment is provided with the process unit 9 described above, the color laser printer 1 can prevent damage to the developer cartridge 13 by the drive force inputted from the motor 81 into the coupling member 58 of the developer cartridge 13 while the developer cartridge 13 is in the detached position.

5. Modification of the Embodiment

According to the preferred embodiment described above, the detection gear 63 of the developer cartridge 13 is configured of a sector gear having the toothless region. When the developer cartridge 13 is mounted in the process frame 12, the detection gear 63 is rotated by pressure from the switching boss 42 so that the toothless region of the detection gear 63 is positioned opposite the agitator gear 62. Consequently, the gear train 56 is switched from the transmitting state to the interrupting state.

Figure 9A:
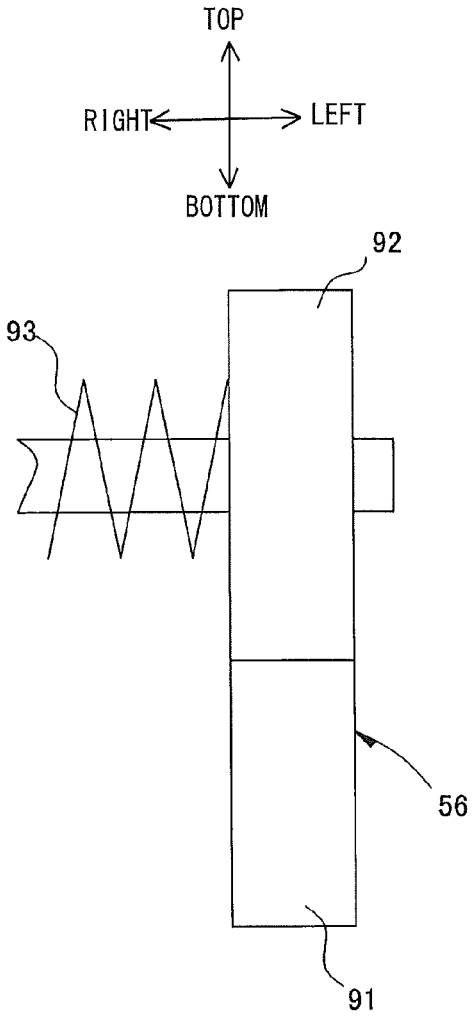
FIG. 9(*a*) is a diagram explaining engagement between a detection gear and an agitator gear when a developer cartridge according to a modification of the embodiment is at the image forming position.
Figure 9B:
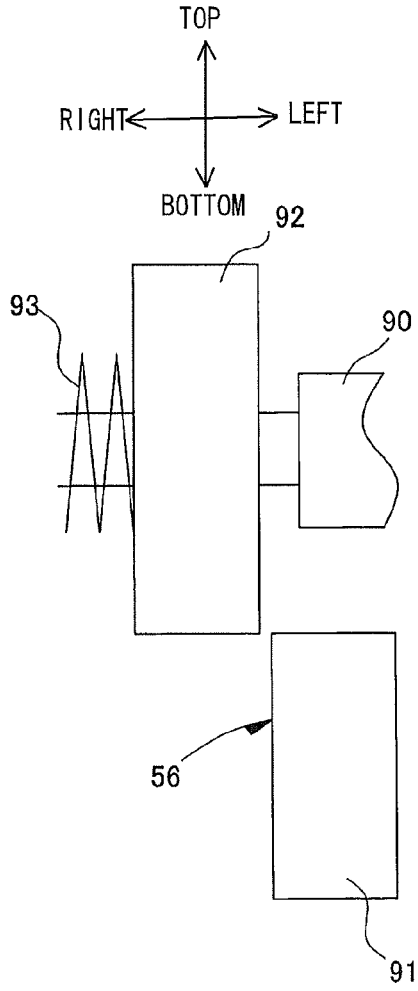

However, as shown in FIGS. 9(*a*) and 9(*b*), when employing a detection gear 92 according to a modification of the embodiment, the gear train 56 can be switched from the transmitting state to the interrupting state by sliding the detection gear 92 along the left-to-right direction. In the modification, like parts and components are designated with the same reference numerals to avoid duplicating description.

More specifically, the detection gear 92 is capable of sliding in the left and right directions (an axial direction of the detection gear 92). When the detection gear 92 is slid leftward, an agitator gear 91 engages with the detection gear 92 (FIG. 9(*a*)). When the detection gear 92 is slid rightward, the agitator gear 91 is disengaged from the detection gear 92 (FIG. 9(*b*)).

A compression spring 93 is provided for urging the detection gear 92 leftward. A switching boss 90 is disposed in a position for contacting the rotational shaft of the detection gear 92 on the left side thereof when the developer cartridge 13 is in the detached position (FIG. 9(*b*)).

When mounting the developer cartridge 13 in the process frame 12, the developer cartridge 13 is placed in the detached position. At this time, the switching boss 90 contacts the left side of the rotational shaft of the detection gear 92 and slides the detection gear 92 rightward against the urging force of the compression spring 93. Consequently, the detection gear 92 is disengaged from the agitator gear 91, switching the gear train 56 into the interrupting state.

When the developer cartridge 13 is placed in the image-forming position, the switching boss 90 is separated from the rotational shaft of the detection gear 92, allowing the urging force of the compression spring 93 to slide the detection gear 92 leftward (FIG. 9(*a*)). Consequently, the detection gear 92 is engaged with the agitator gear 91, switching the gear train 56 to the transmitting state.

According to the modification of the embodiment, the gear train 56 including the detection gear 92 and the agitator gear 91 is switched to the interrupting state when the switching boss 90 pushes the rotational shaft of the detection gear 92 rightward. Hence, the detection gear 92 and the agitator gear 91 can be reliably disengaged by sliding the detection gear 92 rightward, preventing damage to the detection gear 92.

In the preferred embodiment described above, the gear train 56 is switched from the transmitting state to the interrupting state by disengaging the detection gear 63 from the agitator gear 62, but the method of switching the gear train 56 according to the present invention is not limited to this particular combination of gears. For example, the gear train 56 may be switched to the interrupting state by disengaging the idler gear 61 and the agitator gear 62.

What is claimed is:

1. A process unit comprising:

a casing;

a developer unit detachably mountable in the casing and movable between an image-forming position and a detached position, wherein an image forming operation can be performed when the developer unit is at the image-forming position, and the developer unit is detached from the casing when the developer unit is at the detached position, the developer unit including:

a developing member;

a drive force input unit configured to receive input of a drive force from outside of the developer unit; and a drive force transmitting unit configured to transmit the drive force inputted into the drive force input unit; and a switching member provided on the casing and configured to switch the drive force transmitting unit between a transmitting state in which the drive force is transmitted and an interrupting state in which transmission of the drive force is interrupted, wherein the drive force input unit is configured to receive the input of the drive force regardless of whether the developer unit is positioned at the image-forming position or the detached position, wherein the switching member is configured to switch the drive force transmitting unit to the transmitting state when the developer unit is at the image-forming position, and the switching member is configured to switch the drive force transmitting unit to the interrupting state when the developer unit is at the detached position.

2. The process unit according to claim 1, wherein the switching member is configured to press the drive force transmitting unit to switch the drive force transmitting unit to the interrupting state when the developer unit is at the detached position.

3. The process unit according to claim 2, wherein the switching member is configured to switch the drive force transmitting unit to the interrupting state by rotating the drive force transmitting unit.

4. The process unit according to claim 2, further comprising an urging member configured to urge the drive force transmitting unit such that the drive force transmitting unit is normally in the transmitting state.

5. The process unit according to claim 1, wherein the drive force transmitting unit includes a plurality of gears engaged with each other, and the switching member is configured to disengage an engagement of the plurality of gears to switch the drive force transmitting unit to the interrupting state.

6. The process unit according to claim 5, wherein the plurality of gears has an information gear configured to specify information related to a usage of the developer unit when the information gear changes an orientation thereof, and the switching member is configured to switch the information gear from the other gear of the plurality of gears.

7. The process unit according to claim 6, wherein the information gear has a contact part corresponding to the information, and the casing has a protruding member that protrudes from the casing upon contacting the contact part, wherein when the developer unit is at the detached position, the switching member is located between the contact part and the protruding member and restricts contact therebetween.

8. The process unit according to claim 6, wherein the switching member is configured to press the information gear along an axial direction of the information gear to switch the drive force transmitting unit to the interrupting state.

9. The process unit according to claim 1, wherein the casing supports a plurality of photosensitive members arranged parallel to each other in tandem and spaced at intervals, and a plurality of developer units is detachably mounted in the casing and corresponds to each photosensitive member, and a plurality of switching members is provided on the casing and corresponds to each developer unit.

10. An image forming device comprising:

a process unit including:

a casing;

a developer unit detachably mountable in the casing and movable between an image-forming position and a detached position, wherein an image forming operation can be performed when the developer unit is at the image-forming position, and the developer unit is detached from the casing when the developer unit is at the detached position, the developer unit including:

a developing member;

a drive force input unit configured to receive input of a drive force from outside of the developer unit; and a drive force transmitting unit configured to transmit the drive force inputted into the drive force input unit; and a switching member provided on the casing and configured to switch the drive force transmitting unit between a transmitting state in which the drive force is transmitted and an interrupting state in which transmission of the drive force is interrupted, wherein the drive force input unit is configured to receive the input of the drive force regardless of whether the developer unit is positioned at the image-forming position or the detached position, wherein the switching member is configured to switch the drive force transmitting unit to the transmitting state when the developer unit is at the image-forming position, and the switching member is configured to switch the drive force transmitting unit to the interrupting state when the developer unit is at the detached position; and a drive source configured to input the drive force to the drive force input unit.

* * * * *